US006935324B2

(12) United States Patent
Watson et al.

(10) Patent No.: US 6,935,324 B2
(45) Date of Patent: Aug. 30, 2005

(54) PAINTBALL MUNITION CHAMBER AND PAINTBALL GUN UTILIZING THE SAME

(76) Inventors: Jason D. Watson, 3328 County Rd. 73, Crown City, OH (US) 45623; John L. Smith, Rt 1 Box 300, Glenwood, WV (US) 25520

( * ) Notice: Subject to any disclaimer, the term of this patent is extended or adjusted under 35 U.S.C. 154(b) by 0 days.

(21) Appl. No.: 10/715,046

(22) Filed: Nov. 17, 2003

(65) Prior Publication Data

US 2005/0103317 A1 May 19, 2005

(51) Int. Cl.[7] ..... F41B 11/02
(52) U.S. Cl. ..... 124/49; 124/74
(58) Field of Search ..... 124/45, 49, 50, 124/73, 74

(56) References Cited

U.S. PATENT DOCUMENTS

| | | | | | |
|---|---|---|---|---|---|
| 249,399 | A | * | 11/1881 | Randell | 124/27 |
| 1,152,447 | A | * | 9/1915 | Sproull | 124/62 |
| 1,195,597 | A | * | 8/1916 | Lucas | 124/29 |
| 1,205,166 | A | * | 11/1916 | Dettra | 124/29 |
| 1,287,197 | A | * | 12/1918 | Blackshear | 124/29 |
| 1,480,344 | A | * | 1/1924 | Bowman | 124/21 |
| 3,204,625 | A | | 9/1965 | Sheperd | |
| 3,209,741 | A | * | 10/1965 | Hiroshi | 124/49 |
| 4,004,566 | A | | 1/1977 | Fischer | |
| 4,227,508 | A | | 10/1980 | D'Andrade | |
| 4,819,609 | A | | 4/1989 | Tippmann | |
| 5,097,816 | A | | 3/1992 | Miller | |
| 5,166,457 | A | | 11/1992 | Lorenzetti | |
| 5,205,270 | A | * | 4/1993 | Szente | 124/50 |
| 5,282,454 | A | | 2/1994 | Bell et al. | |
| 5,505,188 | A | | 4/1996 | Williams | |
| 5,511,333 | A | | 4/1996 | Farrell | |
| 5,515,838 | A | | 5/1996 | Anderson | |
| 5,673,679 | A | | 10/1997 | Walters | |
| 5,771,875 | A | | 6/1998 | Sullivan | |
| 5,794,606 | A | | 8/1998 | Deak | |
| 5,809,983 | A | | 9/1998 | Stoneking | |
| 5,816,232 | A | | 10/1998 | Bell | |
| 5,850,826 | A | | 12/1998 | Guthrie | |
| 5,878,736 | A | | 3/1999 | Lotuaco, III | |
| 5,954,042 | A | | 9/1999 | Harvey | |
| 6,003,504 | A | * | 12/1999 | Rice et al. | |
| 6,015,058 | A | * | 1/2000 | Parks | |
| 6,055,975 | A | * | 5/2000 | Gallagher et al. | |
| 6,138,656 | A | * | 10/2000 | Rice et al. | |
| 6,213,110 | B1 | * | 4/2001 | Christopher et al. | |
| 6,305,367 | B1 | * | 10/2001 | Kotsiopoulos et al. | |
| D459,767 | S | | 7/2002 | Rushton | |
| 6,415,781 | B1 | * | 7/2002 | Perrone | |
| 6,467,473 | B1 | * | 10/2002 | Kostiopoulos | |
| 6,470,872 | B1 | * | 10/2002 | Tiberious et al. | |
| 6,481,432 | B2 | * | 11/2002 | Rushton et al. | |
| 6,488,019 | B2 | * | 12/2002 | Kotsiopoulos | |
| 6,508,384 | B1 | * | 1/2003 | Tien et al. | |

* cited by examiner

*Primary Examiner*—John A. Ricci
(74) *Attorney, Agent, or Firm*—Robert R. Waters; Brian W. Foxworthy; Waters Law Office, PLLC

(57) ABSTRACT

A hopper for a paintboll gun is disclosed. The hopper is a gravity feed hopper and has a lower profile than those in the previous art. The hopper fits closely to the profile of the paintball gun and may have multiple chambers along with unidirectional gates to control the flow between chambers and within chambers as well. This invention may take the form of a hopper mounted onto a previous type of paintboll gun as an aftermarket add-on or it may be built into the paintball gun itself as part of its construction.

23 Claims, 7 Drawing Sheets

PAINTBALL MUNITION CHAMBER AND PAINTBALL GUN UTILIZING THE SAME

FIELD OF THE INVENTION

This invention relates generally to paintball guns. More specifically, the invention relates to a method and apparatus for a hopper holding the paintballs to be fired from a paintball gun. The current invention is a lower profile hopper essentially fitting into the form of the gun and may be either a retrofit to current paintball gun designs, or it may be integrated into the gun at the time of manufacture.

BACKGROUND OF THE INVENTION

Paintball sporting has grown in popularity as a form of recreation over the last 20 years. The game is a form of simulated combat and typically uses gas powered guns which are capable of propelling marker dye filled gelatinous balls approximately 0.68" in diameter at speeds around 290 feet per second. These paintballs rupture when striking an object, leaving the object marked by the dye contents. The paintballs are fired at opponents, and any person hit by a paintball that ruptures will experience an identifiable mark and be put out of the game. If the mark is on the gun, or anything else carried or worn by the opponent, the opponent is also out of the game. If an opponent is hit by a paintball that does not rupture and leave a paint mark, that opponent is not out. Therefore, as to the paintball itself, there is a balance that must be struck for a paintball that can be handled and loaded into the breech of a gun and accelerated suddenly without rupturing, and yet will rupture on impact at the target.

Over time, paintball guns have become more and more sophisticated, developing to include semi-automatic and automatic models. These models can use a significant quantity of paintballs in a short period of time during the course of a game. To accommodate this rate of paintball usage, hoppers were developed which attach to the gun near its breech, hold a substantial number of paintballs, and feed the gun. The guns themselves are not particularly large and the typical hopper can add significantly to the profile that the overall assembly presents. Although the hopper is effective for storing quantities of paintballs, it can also increase the size of target presented by the user. A large hopper also detracts significantly from the appearance of the gun. In general, most paintballs enthusiasts prefer a paintball gun that comes as close as possible to the appearance of a semi-automatic weapon in order to bolster the ambiance of the game.

DESCRIPTION OF THE RELATED ART

Paintball hoppers and loading mechanisms have previously been found in a number of prior art patents. U.S. Pat. No. 5,097,816 by Miller shows an early approach to holding a sufficient quantity of paint balls for automated firing. A cannister attaches to the gun above the breech. Gravity conducts the balls down a spiral track in the cannister which is filled from a port in its top. The single file spiral prevents jams which can interrupt the flow of paintballs and put a player at a disadvantage until the proper flow is re-established.

A simpler, and probably the most common type of paintball hopper is seen in U.S. Pat. No. 5,166,457 by Lorenzetti. The Lorenzetti hopper is oriented above the breech and has a generally curved bottom directing the paint balls to a tube leading to the breech. The illustrations in the Lorenzetti patent do not necessarily represent the actual size relationship between the hoppers and guns. Typically, the hopper appears much larger in relation to the gun than shown by Lorenzetti. Any jams may be cleared by shaking the gun and hopper assembly. Several inventions in this field relate to means of preventing jams in hoppers of this type.

Perhaps the patent most relevant to the present invention is U.S. Pat. No. 5,954,042 by Harvey. Harvey solves the problem of a high profile gravity feed hopper located above the gun barrel by placing a large hopper below the gun barrel and forward of the trigger. The paintballs are fed part way up to the breech via a powered paddle wheel. The paintballs are driven through a tube the remainder of the distance to the breech by the pressure of paintballs fed by the paddle wheel into the stack in the tube. An electrical motor, overload circuit, spring, and one way clutch keep the paddle wheel biased toward feeding paintballs, but not necessarily constantly turning. Harvey provides one solution that is adaptable to current paintball gun models, but it is also more complex than the gravity feed hoppers, and uses mechanical manipulation of the paintballs to feed the gun. This may increase the likelihood of damaging the paintballs.

Another approach is illustrated in a series of patents by Kostiopoulos, U.S. Pat. Nos. 6,305,367; 6,467,473 and 6,488,019. In all of the patents, FIGS. 3–5C show aspects of a hopper mounted along side of and below the barrel of the paintball gun. Conveyors in the bottom of the hopper move the paintballs from there to the breech via a tube. Here again, the paintballs are pushed to the breech by those behind them. This series of patents also shows other methods of feeding a paintball gun from below or remotely. All of them feature means of mechanically moving the paintballs.

U.S. Pat. No. 5,771,875 by Sullivan is directed to simulating the look of a real gun as well as reducing the target presented by the gun and magazine assembly. In Sullivan, the hopper magazine is located where the forward stock of a real gun would be. Below the breech, in the area where a magazine would be, is a housing with a feeder mechanism. The paintballs flow from the hopper magazine to the housing and are fed upward to the breech. To maintain a realistic gun appearance, the breech must be loaded from the bottom. Thus, Sullivan requires a gun made differently from most paintball guns which load from the top half of the barrel. In short, Sullivan is an entirely new type of paintball gun, which uses mechanical means to load from the bottom of the breech.

Two patents that simulate the look of a pistol are U.S. Pat. No. 5,511,333 by Farrell and U.S. Pat. No. 6,470,872 B1 by Tiberius et al. Both of these use spring loaded clips which are within the profile of the gun to hold and feed the paintballs. Their gas supplies are located within the profile of the gun as well. In the case of Tiberius, both the paintballs and gas charge are in the handle of the pistol. Farrell has its paintball clip running along the top of the barrel and the gas charge lies along the bottom of the barrel. In both cases the magazine has a limited capacity and the spring introduces undesirable stress on the paintballs.

SUMMARY OF THE INVENTION

The present invention is an improved hopper for holding paintballs and feeding them to a paintball gun. The hopper is in communication with the chute leading into the breech of a typical paintball gun and more closely fits to the shape of the rest of the gun than typical paintball hoppers and may be shaped in such a manner as to simulate the overall look of an actual gun. A smaller portion of the hopper is above the breech and runs from a short distance in front of the breech to a point above and just to the rear of the handle and trigger where most paintball guns terminate. From this point another, larger portion of the hopper extends back and slightly downward from the rear of the gun. This section may be shaped to generally imitate the shoulder stock on a real gun. A one way gate operates between these two sections of the hopper and allows paintballs to flow from the larger, rear section to the smaller, forward section and prevents their return to the rear. The hopper is filled through a port in the rear section.

To use the hopper, it is filled through the rear section with the gun is tilted downward. This allows the paintballs to run down to fill the forward section of the hopper. The gun is fired in a generally horizontal position and the paintballs flow to the breech due to the shape of the bottom of that section and gravity. As the forward section is emptied, it can be re-supplied by tilting the gun downward. Frequently, during the course of playing the game, a paintball gun will be tilted downwards, and the forward section would automatically be re-supplied in those cases. The one way gate keeps paintballs from flowing back to the rear section of the hopper. In some embodiments, the size of the forward section could be increased and another gate used to control flow between this additional space and the section feeding the breech of the gun. Also, other gates could be utilized in various embodiments. For example, a gate could be placed immediately behind the breech in the smaller portion of the hopper that is above the breech. This gate would prevent paintballs from running to the back of this smaller portion, when the barrel is elevated significantly above the breech of the gun, such as when aiming up hill.

The previous description of this invention has focused on a hopper added as a retrofit to a previously made gun. It can also be applied to a new gun wherein the hopper is made integral to the body of the gun. This general embodiment of the invention could lead to many particular embodiments depending on the model of real gun being imitated. The forestock would present opportunities for additional capacity as well as any imitation munition clip or an imitation second barrel simulating a gun with over and under barrels, etc. With the inherent advantages of building a gun around this concept from the beginning, it is conceivable that some embodiments would have communication of paintballs from the forestock to the shoulder stock and from there to the portion of the hopper over the breech or other flow paths. Such configurations would have suitable gating to keep the paintballs flowing effectively.

Also, individuals playing paintball will sometimes carry tubes of paintballs with them while playing. These are used for rapid refill of the hopper when the original load is used up. Some embodiments of the current invention could have such refill tubes shaped like part of the hopper and made to be quickly interchangeable on the paintball gun. As an example, the shoulder stock portion of the hopper could be removable and interchangeable, allowing a refill to replace an empty shoulder stock. This applies to both new gun designs and hoppers applied:after the fact to current popular guns.

A primary objective of this invention is to provide a lower profile hopper for a paintball gun with the hopper closely following the body of the gun.

Another objective of the present invention is to provide this lower profile utilizing a gravity feed method to prevent rupturing the paintballs.

Yet another objective of the present invention is to provide a more realistic shape to the paintball gun, simulating assault rifles or other conventional firearms.

Still yet another objective of this invention is to provide a lower stack height of paintballs in the hopper to prevent jams.

A further objective of this invention is to provide a system of interchangeable refills.

As discussed above, the article of the present invention overcomes the disadvantages inherent in prior art methods and prior art devices for carrying paintballs and feeding them to a paintball gun. In this respect, before explaining at least one embodiment of the invention in detail, it is to be understood that the invention is not limited in its application to the details of construction and/or to the arrangement of the support structure set forth in the following description or illustrated in the drawings. The invention is capable of other embodiments and of being practiced and carried out in various and diverse ways. Also, it is to be understood that the phraseology and terminology employed herein are for the purposes of description and should not be regarded as limiting.

Accordingly, those skilled in the art will appreciate that the concept upon which this invention is based may readily be utilized as a basis for the design of other structures, methods, and systems for carrying out the purposes of the present invention. It is important, therefore, that the claims be regarded as including such equivalent constructions insofar as they do not depart from the spirit and scope of the present invention.

Furthermore, the purpose of the foregoing Abstract is to enable the U.S. Patent and Trademark Office and the public generally, and especially including the practitioners of the art who are not familiar with patent or legal terms or phraseology, to determine quickly from a cursory inspection, the nature and essence of the technical disclosure of the application. The Abstract is neither intended to define the invention of the application, nor is it intended to be limiting to the scope of the invention in any respect.

BRIEF DESCRIPTION OF THE DRAWINGS

Additional utility and features of this invention will become more fully apparent to those skilled in the art by reference to the following drawings, wherein all components are designated by like numerals and described more specifically.

DETAILED DESCRIPTION OF THE PREFERRED EMBODIMENT

The following discussion illustrates only some of the possible configurations claimed in this invention and should not be interpreted as limiting the scope of the claims.

Figure 1:
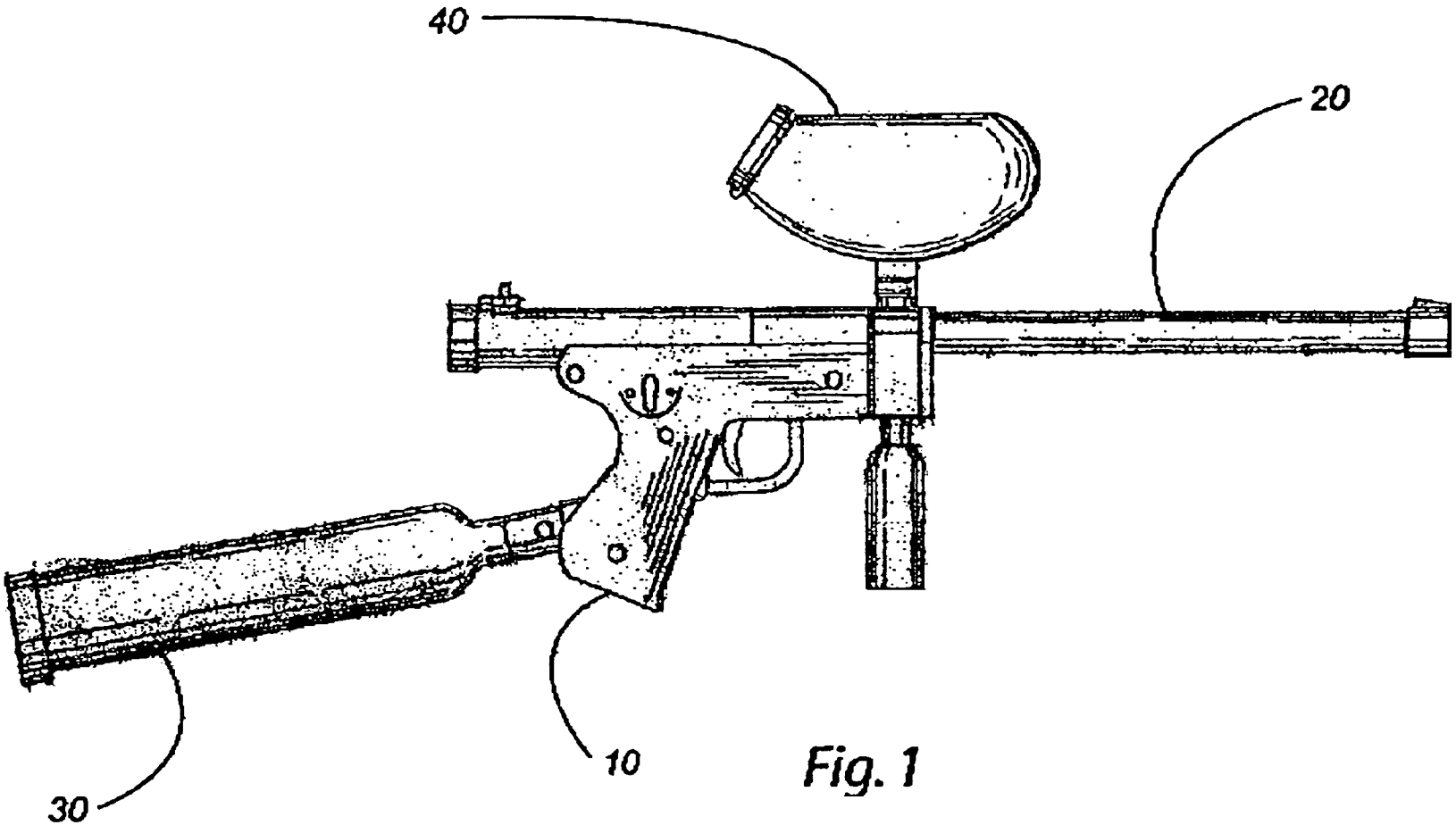
Fig. 1 PRIOR ART
FIG. 1 is a side view of a prior art paintball gun featuring a prior art paintball hopper mounted thereon.

The present invention is a new hopper configuration for paintball guns. FIG. 1 shows a side view of a prior art paintball gun which has the following: a working section (10) containing the mechanical workings of a paintball gun such as the trigger, the bolt, and valves; a barrel (20) through which the paintballs are propelled; a gas cylinder (30) which supplies pressurized gas to power the gun; and a hopper (40) which stores a quantity of paintballs which are gravity fed into the working section (10) of the paintball gun.

Figure 2:
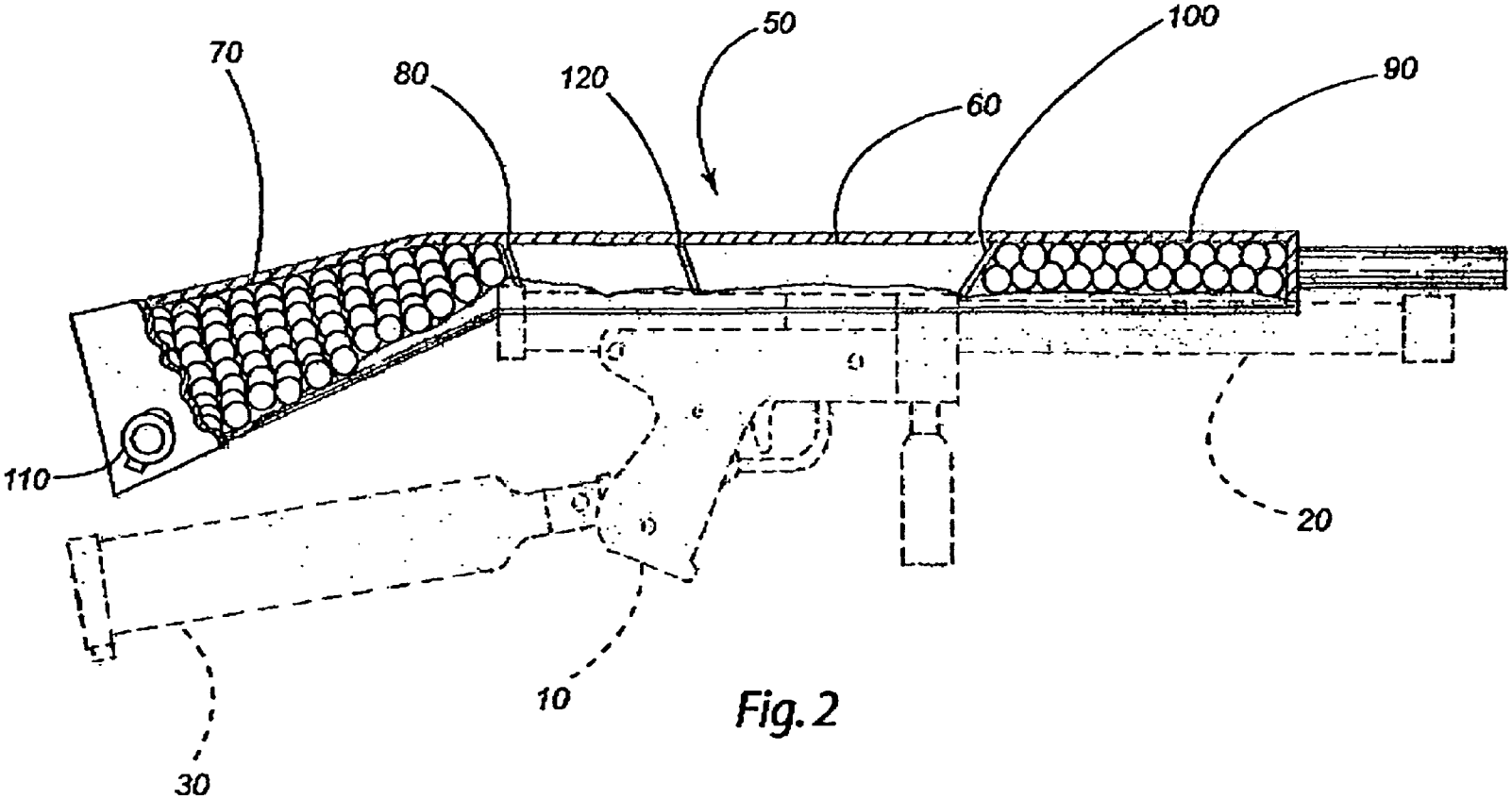
FIG. 2 is a side view of a current art paintball gun with a paintball hopper of the present invention attached to the gun.
Figure 7:
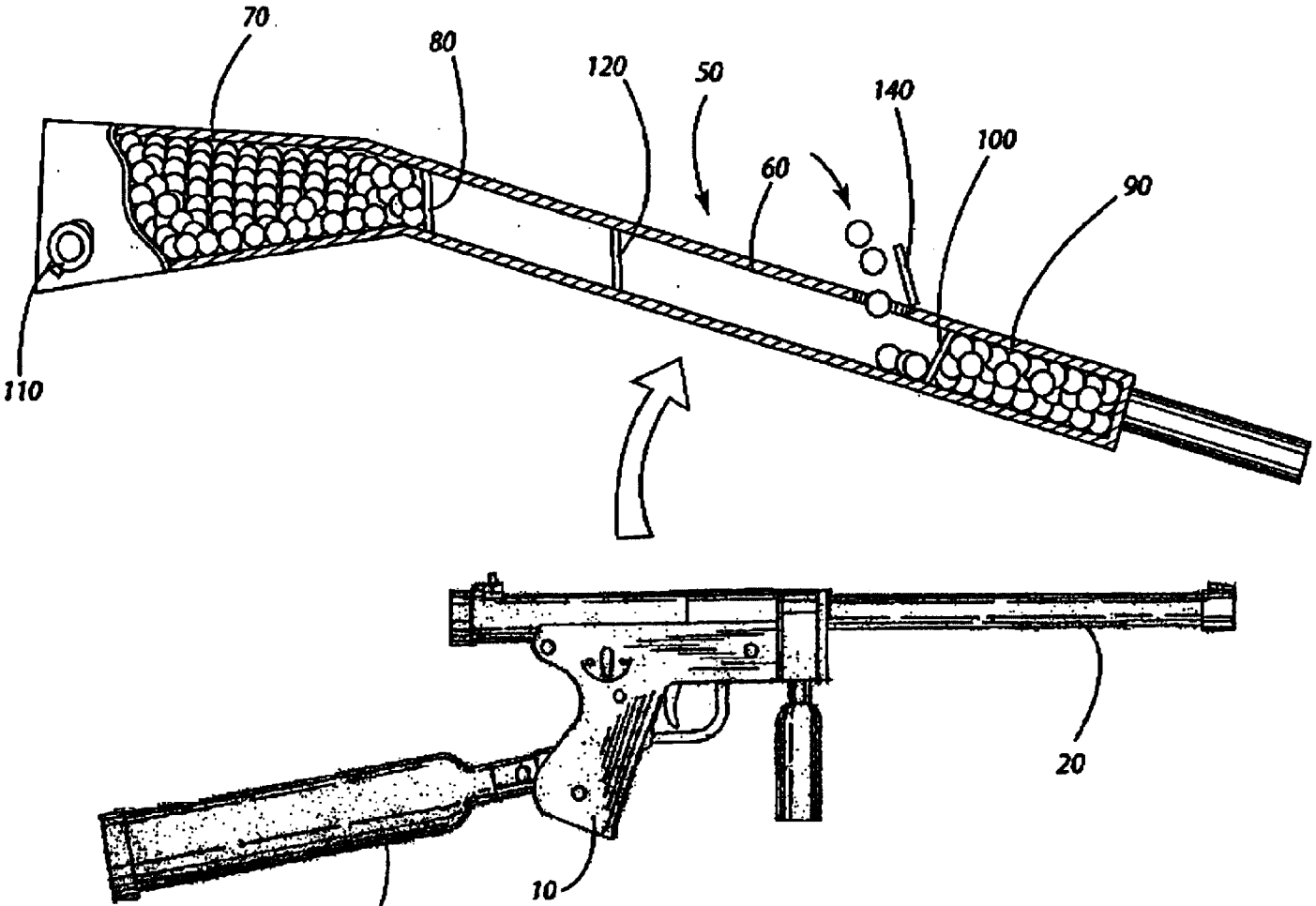
FIG. 7 shows a paintball gun in which the hopper is separated from the gun.

FIG. 2 shows the hopper (50) of the preferred embodiment of the current invention placed on the prior art paintball gun shown in FIG. 1. In general, the hopper (50) is shaped to provide the overall look of a real gun. Within the hopper (50) is a central chamber (60) located above the working portion (10) of the paintball gun. The central chamber's (60) bottom is shaped to direct paintballs contained therein to the working portion (10) of the paintball gun. The paintball gun is gravity fed. Extending back from the central chamber (60) is a rear chamber (70) appropriately shaped to resemble a similarly located portion on a real gun such as a shoulder butt. Between the rear chamber (70) and the central chamber (60) is a rear gate (80) which is constructed so as to be normally gravity actuated, and which allows paintballs to flow from the rear chamber (70) to the central chamber (60) but not in the other direction. Extending forward from the central chamber (60) is a forward chamber (90) which conforms to the look of a real gun. Between the forward chamber (90) and the central chamber (60) is a forward gate (100) which is constructed so as to be normally gravity actuated, and which allows paintballs to flow from the forward chamber (90) to the central, chamber (60) but not in the other direction. FIG. 7 shows hopper (509 separated from the paintball gun.

Figure 3A:
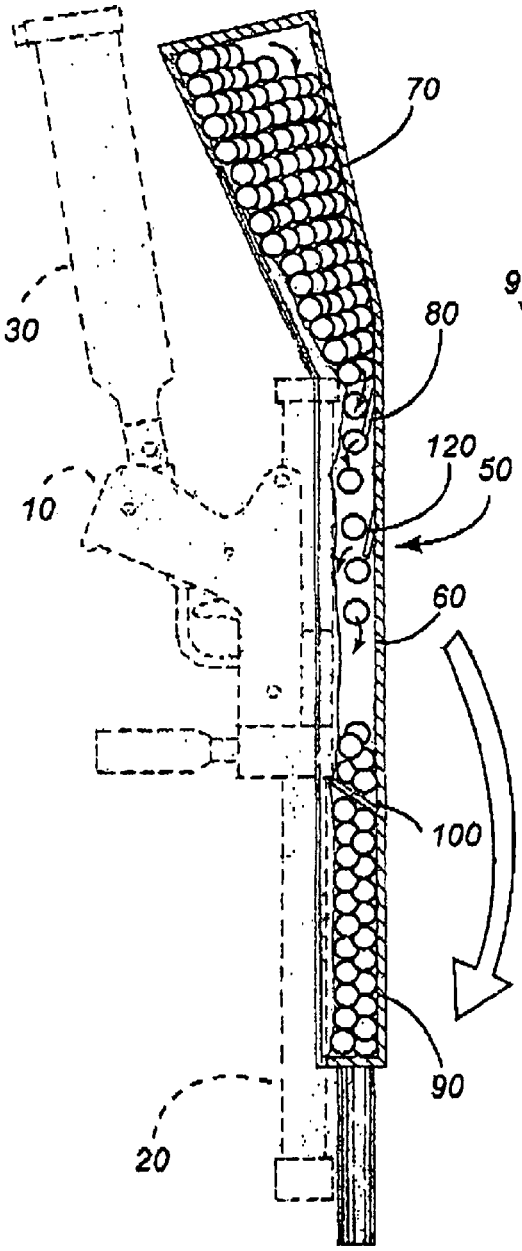
FIG. 3*a* shows the flow of paintball from the rear chamber of the hopper to the central chamber.

FIG. 3*a* shows the working of the paintball hopper (50) as the gun is turned with its barrel (20) toward the ground to refill the central chamber (60). From the force of gravity and the force of paintballs against it, rear gate (80) opens and allows paintballs to flow from the rear chamber (70) to the central chamber (60). Forward gate (100) remains closed due to gravity and prevents the paintballs from passing through the central chamber (60) on into the forward chamber (90). When the gun is returned to a normal, nearly horizontal, position, the paintballs are retained in the central chamber (60) to be fed into the working portion (10) of the gun.

Figure 3B:
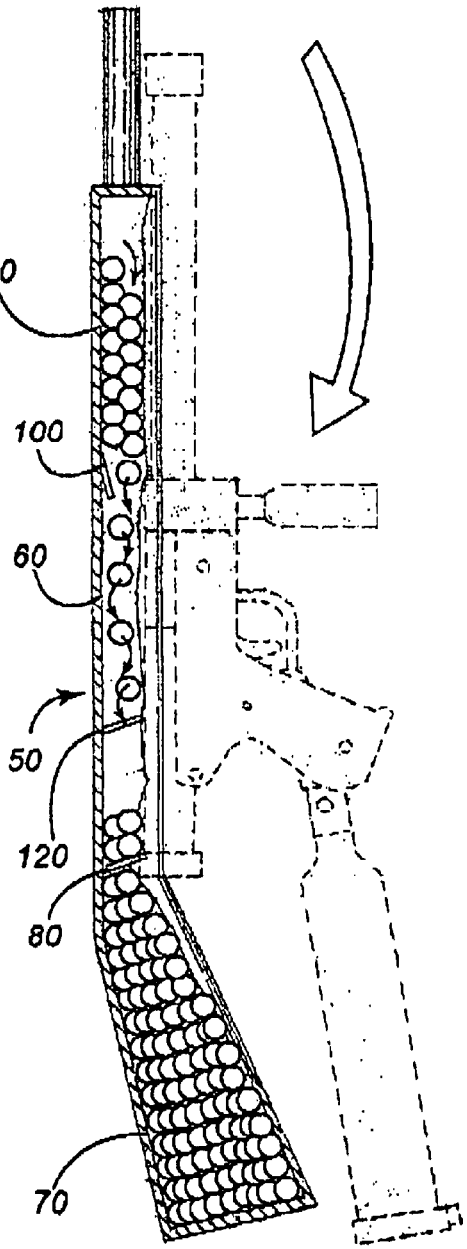
FIG. 3*b* shows the flow of paintballs from the forward chamber of the hopper to the central chamber.

FIG. 3*b* shows the working of the paintball hopper (50) to refill the central chamber (60) by lifting the barrel (20) of the gun upward. From the force of gravity and the force of paintballs against it, the forward gate (100) opens and allows paintballs to flow from the forward chamber (90) to the central chamber (60). Rear gate (80) remains closed due to gravity and prevents the paintballs from passing through the central chamber (60) on into the rear chamber (70). When the gun is returned to a normal, nearly horizontal, position, the paintballs are retained in the central chamber (60) to be fed into the working portion (10) of the paintball gun.

For the purposes of filling hopper (50), it should be appreciated by one skilled in the art that there are many locations where an opening with a closure may be placed on the hopper (50). It should also be appreciated that there are innumerable configurations for openings with closures that could be applied to the present invention. In FIG. 2, rear fill port (110) is located in rear chamber (70) of hopper (50). Rear fill port (110) is shown in a closed state. In FIG. 7, where hopper (50) is shown removed from the paintboll gun, another fill port, central fill port (140) is shown located on central chamber (60). In FIG. 7 central fill port (140) is shown in an open state with paint balls transiting through it into central chamber (60) to fill hopper (50).

Not depicted in the figures is a means for filling the rear chamber (70) or the forward chamber (90) when the opening for filling the hopper (50) is not in that chamber. To do this, means would be provided for manually opening the appropriate gate so that paintballs may flow into the chamber. For example, if an opening is provided in the rear chamber (70) for filling the hopper (50), the gun would be held barrel down while manually holding forward gate (100) open so that paintballs flow from the rear chamber (70), past rear gate (80), through the central chamber (60), past the forward gate (100) and into the forward chamber (90) for storage until the central chamber (60) needs refilled from the forward chamber (90). Again it should be apparent that there are a myriad of ways to manually actuate a gate.

Figure 5:
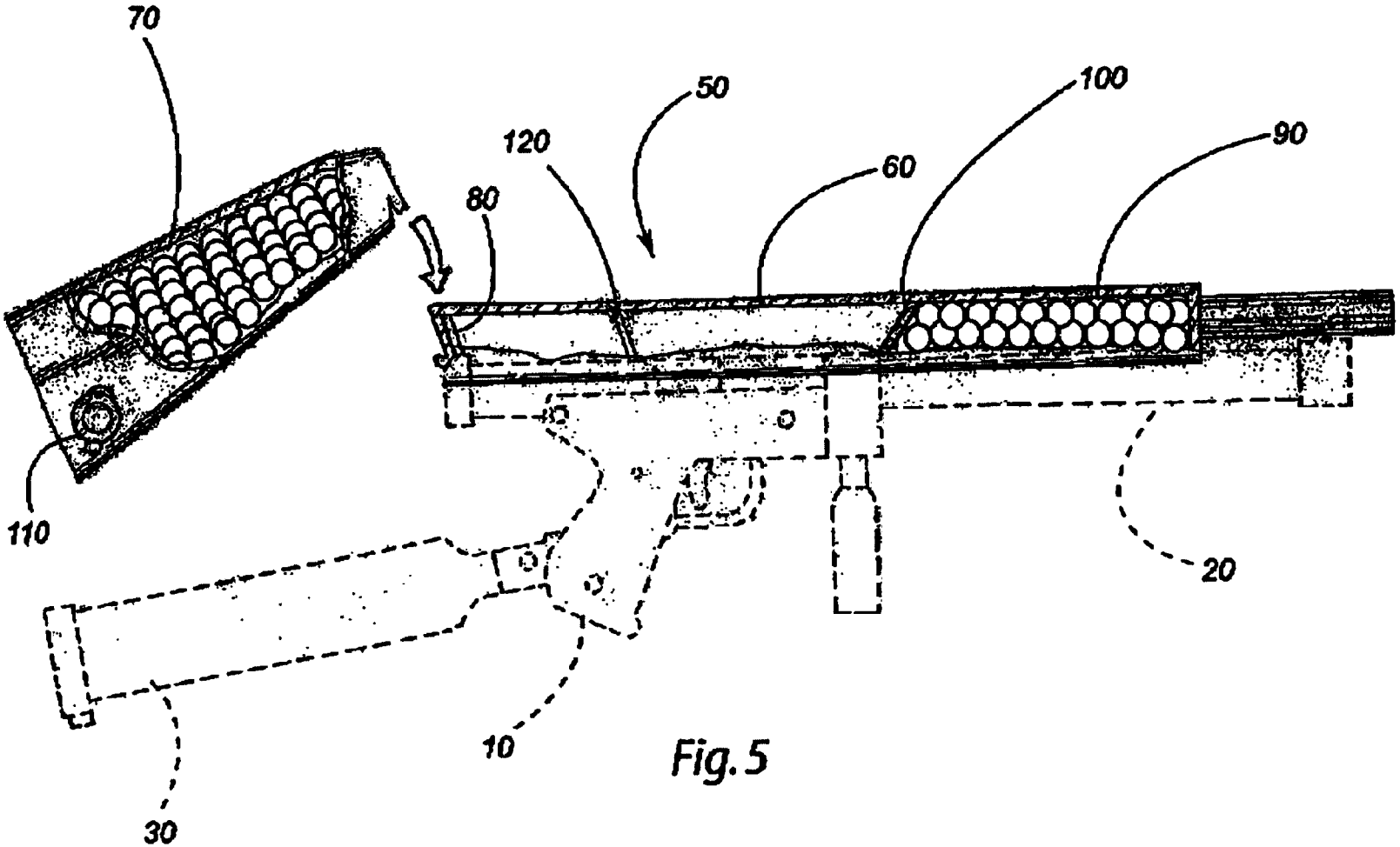
FIG. 5 shows a paintball gun made with the paintball hoppers of the present invention, in which a portion of the hopper is removable and interchangeable with a like removable portion.

It is contemplated that in some embodiments a portion of the hopper (50) may be removable and interchangeable with a like removable portion. For example, in FIG. 2 the rear chamber (70) may be removably attached to the central chamber (60). FIG. 5 illustrates such an arrangement. Rear chamber (70) is shown full and ready to be attached to the back of hopper (50), where the paintballs may flow into central chamber (60) as regulated by rear gate (80). A user may carry an extra rear chamber (70) separate from the hopper (60) and, when needing to add paintballs to the hopper (60), remove the emptied rear chamber (70) and replace it with a full rear chamber (70). With the rear chamber (70) removed, central chamber (60) may also be filled directly from its rear where rear camber (70) attaches. It should be readily apparent that many widely know means for removably joining two chambers would be applicable for such an embodiment. It is also apparent that other chambers in multiple chamber embodiments of this invention would provide similar opportunities for removable chambers used for refills.

It is also contemplated that additional gates could be added to the hopper (50), particularly within the central chamber (60), where they may assist in controlling paintballs while the gun is being actively used and improve the flow of paintballs to the working portion of the paintball gun. Such an additional gate (120) is shown in FIG. 2, FIGS. 3*a* & 3*b*, FIG. 4, FIG. 5, FIG. 6, and FIG. 7. Additional gate (120) is located near where the paintballs exit to the working portion (10) of the paintball gun. Additional gate (120) controls the movement of paintballs in central chamber (60) and keeps the paintballs near the exit when the paintball gun's barrel is elevated. Additional gates like additional gate (120) could also be manually operated while filling the hopper (50). All gates discussed may or may not have the capability of being fixed either in the open or closed position.

Figure 4:
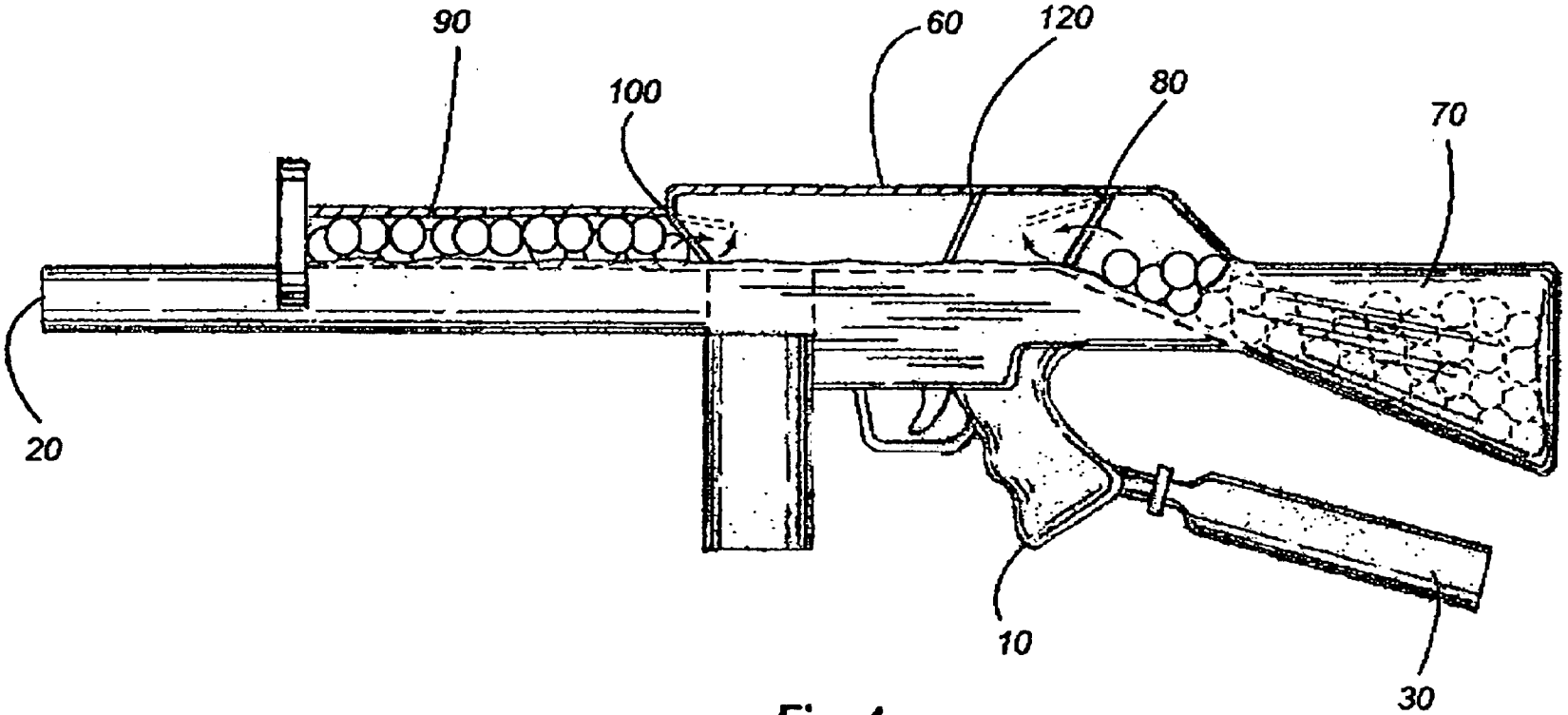
FIG. 4 shows a paintball gun made with the paintball hoppers of the present invention integral to the gun construction.

FIG. 4 depicts a paintball gun which is made with the hopper of the present invention built into the structure of the paintball gun. Overall, the appearance of the paintball gun is intended to be that of a real gun. This embodiment can have all of the elements of the previous embodiments such as a central, rear, and forward chambers separated by gates in between the chambers with the gates controlling the flow of the paintballs. The integral construction of the paintball hopper with the rest of the gun provides many opportunities for increasing the size and number of the chambers.

Figure 6:
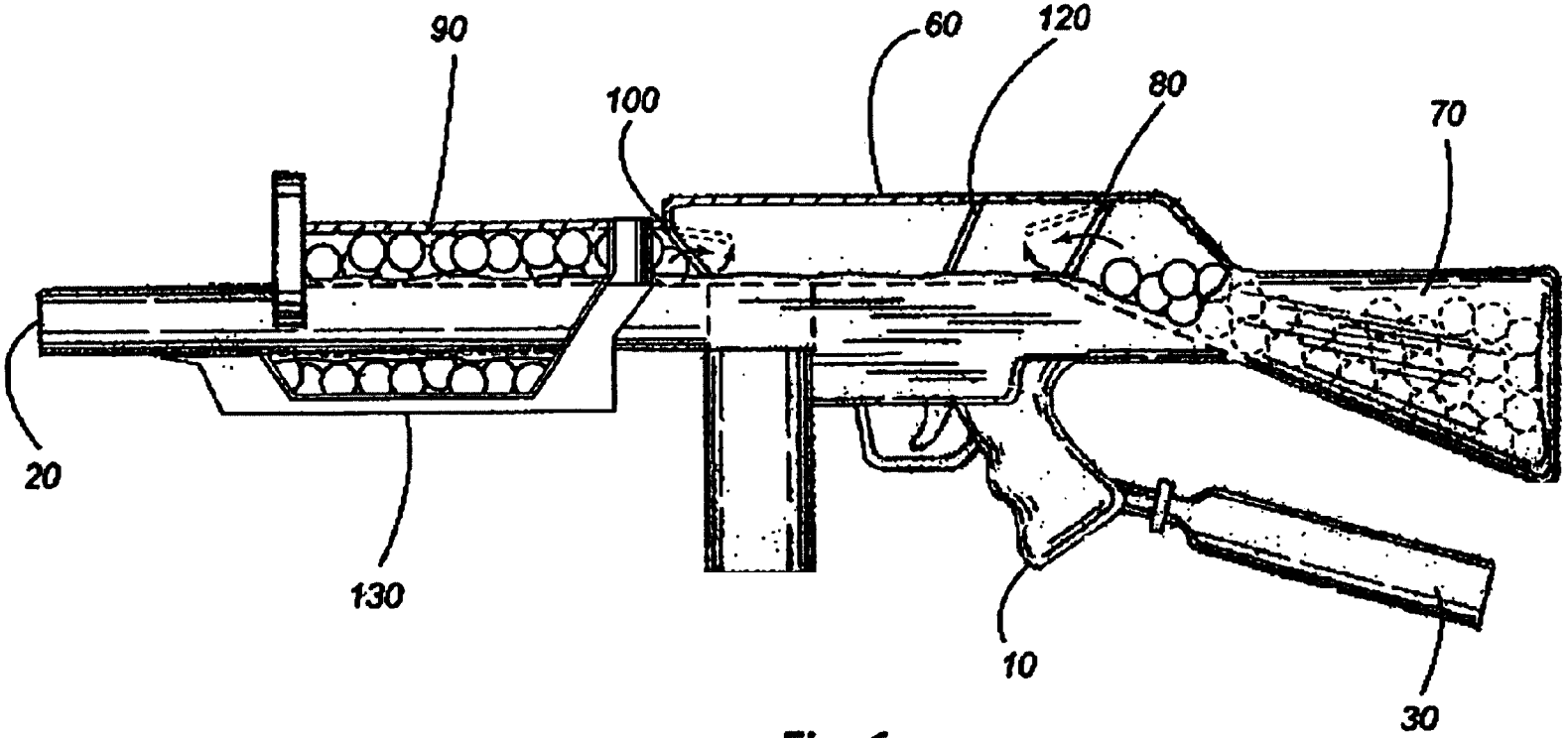
FIG. 6 shows a paintball gun made with the paintball hoppers of the present invention, in which the hopper includes a lower portion beneath the barrel of the gun.

FIG. 6 shows an embodiment of the present invention where the integral construction of the hoppers facilitates the addition of a lower portion 130 to forward chamber 90 beneath barrel 20 of the paintball gun. Provision is made for paintballs to pass from lower portion 130 to the upper portion of forward chamber 90. From there the paintballs may flow to central chamber 60. The order of connection of the chambers may even be varied. For example, if a chamber is added blow the barrel of the paintball gun, it may be more functional to connect this chamber to a chamber in the rear of the gun via a passage through the working portion of the gun. The latter chamber may then be connected to a third chamber located above the working portion of the gun.

It should be noted that all of the figures show a gas cylinder attached to the paintball gun. It is also possible to connect the gas cylinder to the gun with a gas line several feet long. The cylinder can then be carried elsewhere on the user's person and the gun's bulk is decreased. This would have no effect on the present invention.

We claim:

1. An apparatus for holding paintballs and supplying them to a paintball gun comprised of:

a first hollow chamber, an exit, a second hollow chamber, a gate between said first and second hollow chambers, and a fill port;

wherein said first chamber is located above the level of the breech of the gun and runs from a point forward of the breech to a point behind the breech and has a bottom shaped to guide the paintballs to said exit;

wherein said exit is in communication with the paintball gun breech and guides the paintballs to the breech;

said second hollow chamber being in communication with said first hollow chamber at the rear of said first chamber and extending back therefrom;

said gate located between said first and second chambers operating in only one direction to allow paintballs in said second chamber to flow from said second chamber to said first chamber but not the other way;

and said fill port serving as a means for loading paintballs into either said first or said second chambers.

2. The apparatus of claim 1 wherein the apparatus is designed to couple with a paintball gun such that the combined assembly features the general appearance of a conventional firearm.

3. The apparatus of claim 1 wherein an additional gate is located adjacent the breech in said first chamber and operates to prevent paintballs from rolling away from the breech when the gun is held at a significant angle from horizontal.

4. The apparatus of claim 1 wherein said second hollow chamber is separable from said first hollow chamber and interchangeable with a like second hollow chamber.

5. An apparatus for holding paintballs and supplying them to a paintball gun comprised of:

a first hollow chamber mounted above the breech of the gun and extending from a point forward of the breech to a point to the rear of the breech and having a bottom shaped to guide the paintballs to an exit leading to the gun breech;

a second hollow chamber in communication with the rear of said first hollow chamber, extending back from said first hollow chamber;

a gate between said first and said second hollow chamber that operates to allow paintballs to flow from said second chamber to said first chamber but not the other way;

and a fill port said apparatus allowing paintballs to be loaded therein.

6. The apparatus of claim 5 wherein an additional gate is located adjacent the breech in said first chamber and operates to prevent paintballs from rolling away from said breech when the gun is held at a significant angle from horizontal.

7. The apparatus of claim 5 wherein said apparatus is designed to couple with a paintball gun such that the combined assembly features the general appearance of a conventional firearm.

8. The apparatus of claim 5 wherein said second chamber is shaped to serve as the shoulder stock of a rifle.

9. The apparatus of claim 5 wherein said second hollow chamber is separable from said first hollow chamber and interchangeable with a like second hollow chamber.

10. A paintball gun of the type having a gas operated bolt action, said paintball gun having two paintball hoppers integrally built into it, comprising;

a first hopper and a second hopper with a gate between them;

said first hopper being above the level of the breech and in communication with the breech and extending substantially over the operable length of the gun from the barrel to the rear of said bolt action and having its bottom interior shaped to guide the paintballs into the breech;

said second hopper being in communication with the rear of the first hopper and extending back therefrom;

said gate being disposed between said first and second hoppers and operating so as to allow paintballs to flow from the second hopper to the first hopper but not the other direction;

and said second hopper having a port which may be used to fill the paintball gun.

11. The paintball gun of claim 10 wherein a second gate is located in said first hopper at the breech and operates so as to prevent the paintballs from rolling away from the breech when the paintball gun is tilted substantially from horizontal.

12. The paintball gun of claim 10 wherein said integral hoppers are designed such that the paintball gum features the general appearance of a conventional firearm.

13. The apparatus of claim 10 wherein said second hopper is separable from said first hopper and interchangeable with a like second hopper.

14. A paintball gun of the type having a gas operated bolt action, said paintball gun featuring three paintball hoppers integrally built into it, comprising;

a first hopper, a middle hopper, a second hopper, and a first and second gate therein;

said middle hopper being above the level of the breech and in communication with the breech and extending substantially over the operable length of the gun from the barrel to the rear of the bolt action and having its bottom interior shaped so as to guide the paintballs into the breech;

said second hopper being in communication with the rear of the middle hopper and extending back therefrom;

said first sate being disposed between said middle and second hoppers and operating so as to allow paintballs to flow from the second hopper to the middle hopper but not the other direction;

said first hopper being in communication with the front end of the middle hopper and extending forward;

said second gate being disposed between the middle and first hopper and operating so as to allow the paintballs to roll from the first hopper to said middle hopper but not the other direction, unless said second gate is held open for the purpose of filling the first hopper;

and said second hopper having a port which may be used to fill the paintball gun.

15. The paintball gun of claim 14 wherein a third gale is located in said middle hopper at the breech and operates so as to prevent the paintballs from rolling away from the breech when said paintball gun is tilted substantially from horizontal.

16. The paintball gun of claim 14 wherein said second hopper is shaped like the shoulder stock of a long gun.

17. The paintball gun of claim 14 wherein the second hopper is separable from said middle hopper and interchangeable with a like second hopper.

18. The paintball gun of claim 14 wherein said first hopper extends forward under the barrel and is shaped like the forestock of a long gun.

19. The paintball gun of claim 14 wherein said fist hopper extends forward along the barrel and is shaped like a second barrel as in a gun having an over and under barrel arrangement.

20. The paintball gun of claim 14 wherein said first hopper has an upper portion and a lower portion;

said lower portion extending forward under the barrel and being shaped like the forestock of a long gun;

and said upper portion extending forward along the barrel and being shaped like a second barrel as in a gun having an over and under barrel arrangement.

21. The paintball gun of claim 14 wherein said first hopper is separable from said middle hopper and interchangeable with a like first hopper.

22. A paintball gun featuring three paintball hoppers integrally built into it;

comprising a first hopper, a middle hopper, a second hopper, and a first and second gate therein;

said middle hopper being above the level of the breech and in communication with the breech and extending substantially over the operable length of the gun from the barrel to the rear of the bolt action and having its bottom interior shaped so as to guide the paintballs into the breech;

said second hopper being in communication with the rear of the middle hopper and extending back therefrom;

said first gate being disposed between said middle and second hopper and operating so as to allow paintballs to flow from the second hopper to the middle hopper but not the other direction;

said first hopper being in communication with the front end of the second hopper and extending forward;

said second gate being disposed between said second and first hoppers and operating so as to allow the paintballs to roll from said first hopper to the second hopper but not the other direction, unless said second gate is held open for the purpose of filling the first portion;

and said second hopper having through its surface a port which may be used to fill the paintball gun.

23. The paintball gun of claim 22 wherein a third gate is located in said middle hopper at the breech and operates so as to prevent the paintballs from rolling away from the breech when the paintball gun is tilted substantially from horizontal.

* * * * *